US009488945B2

(12) United States Patent
Ishida et al.

(10) Patent No.: US 9,488,945 B2
(45) Date of Patent: Nov. 8, 2016

(54) IMAGE FORMING APPARATUS AND IMAGE FORMING METHOD FOR REDUCING TONER BEARING AMOUNT, AND STORAGE MEDIUM THEREOF

(71) Applicant: CANON KABUSHIKI KAISHA, Tokyo (JP)

(72) Inventors: Tomohito Ishida, Saitama (JP); Tetsuya Atsumi, Tokyo (JP); Megumi Uchino, Tokyo (JP); Shunichi Takada, Soka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/831,992

(22) Filed: Aug. 21, 2015

(65) Prior Publication Data

US 2016/0062290 A1 Mar. 3, 2016

(30) Foreign Application Priority Data

Aug. 26, 2014 (JP) ..... 2014-171637

(51) Int. Cl.

| | |
|---|---|
| ***G03G 15/01*** | (2006.01) |
| ***G03G 15/00*** | (2006.01) |
| ***G03G 15/04*** | (2006.01) |
| ***G03G 15/043*** | (2006.01) |

(52) U.S. Cl.

CPC ..... *G03G 15/5033* (2013.01); *G03G 15/043* (2013.01); *G03G 15/04027* (2013.01); *G03G 2215/0129* (2013.01); *G03G 2215/0164* (2013.01)

(58) Field of Classification Search

CPC ..... G03G 15/5025; G03G 15/5033
USPC ..... 399/39, 49, 51, 72
See application file for complete search history.

(56) References Cited

U.S. PATENT DOCUMENTS 6,768,878 B2 * 7/2004 Komatsu et al. ..... 399/49
8,326,165 B2 12/2012 Kubo et al.

* cited by examiner

*Primary Examiner* — Hoang Ngo
(74) *Attorney, Agent, or Firm* — Rossi, Kimms & McDowell LLP

(57) ABSTRACT

An image forming apparatus that can reduce a toner bearing amount stably regardless of a density of an image. The image forming apparatus comprises a first generating unit which generates a reference pattern, and a second generating unit which generates, based on image data, a correction pattern for thinning out dots at a region from halftone density to high density. The image data is converted based on the reference pattern generated by the first generating unit and the correction pattern generated by the second generating unit. The image forming apparatus further comprises a photoreceptor. The photoreceptor is charged, the charged photoreceptor is exposed based on the converted image data to form an electrostatic latent image, and the electrostatic latent image is developed.

17 Claims, 15 Drawing Sheets

IMAGE FORMING APPARATUS AND IMAGE FORMING METHOD FOR REDUCING TONER BEARING AMOUNT, AND STORAGE MEDIUM THEREOF

BACKGROUND OF THE INVENTION

1. Field of the Invention

The present invention relates to an image forming apparatus and image forming method, and a storage medium thereof.

2. Description of the Related Art

In recent years, there has been a need for reduction in a toner bearing amount in order to save energy in an image forming apparatus which employs an electrophotographic method. In order to reduce a toner bearing amount, a method to reduce exposure intensity of a laser light emitted by an exposure apparatus, a method to perform line screen processing on an image (U.S. Pat. No. 8,326,165), etc. are known. Tone reproduction in a case when line screen processing is performed on the high density portion will be described using conceptual diagrams of FIG. 17A and FIG. 17B.

FIG. 17A and FIG. 17B are diagrams for explaining the line screen processing. FIG. 17A shows a normal screen pattern in which line screen processing is not performed on the high density portion, and FIG. 17B shows a screen pattern in which line screen processing is also performed on the high density portion.

In the meanwhile, when exposure intensity is reduced, an exposure amount is reduced, and hence toner is not deposited on a low-density image, which causes a problem that the low-density image cannot be formed stably. Further, when the line screen processing is performed on image data, the exposure intensity is not reduced; however, there was a problem that an exposed region and a non-exposed region are undesirably formed in a stripe manner, that is, density variability is occurred in a high-density image.

SUMMARY OF THE INVENTION

An object of the present invention is to reduce a toner bearing amount stably regardless of a density of an image.

In an aspect of the invention, there is provided an image forming apparatus comprising a first generating unit configured to generate a reference pattern, a second generating unit configured to generate, based on image data, a correction pattern for thinning out dots at a region from halftone density to high density, a converting unit configured to convert the image data based on the reference pattern generated by the first generating unit and the correction pattern generated by the second generating unit, a photoreceptor, a charging unit configured to charge the photoreceptor, an exposure unit configured to expose the charged photoreceptor based on the image data converted by the converting unit, to form an electrostatic latent image, and a developing unit configured to develop the electrostatic latent image.

According to the present invention, it is possible to suppress decrease of a tone level of an image formed by the image forming apparatus even when a toner bearing amount is reduced.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof.

Figure 1:
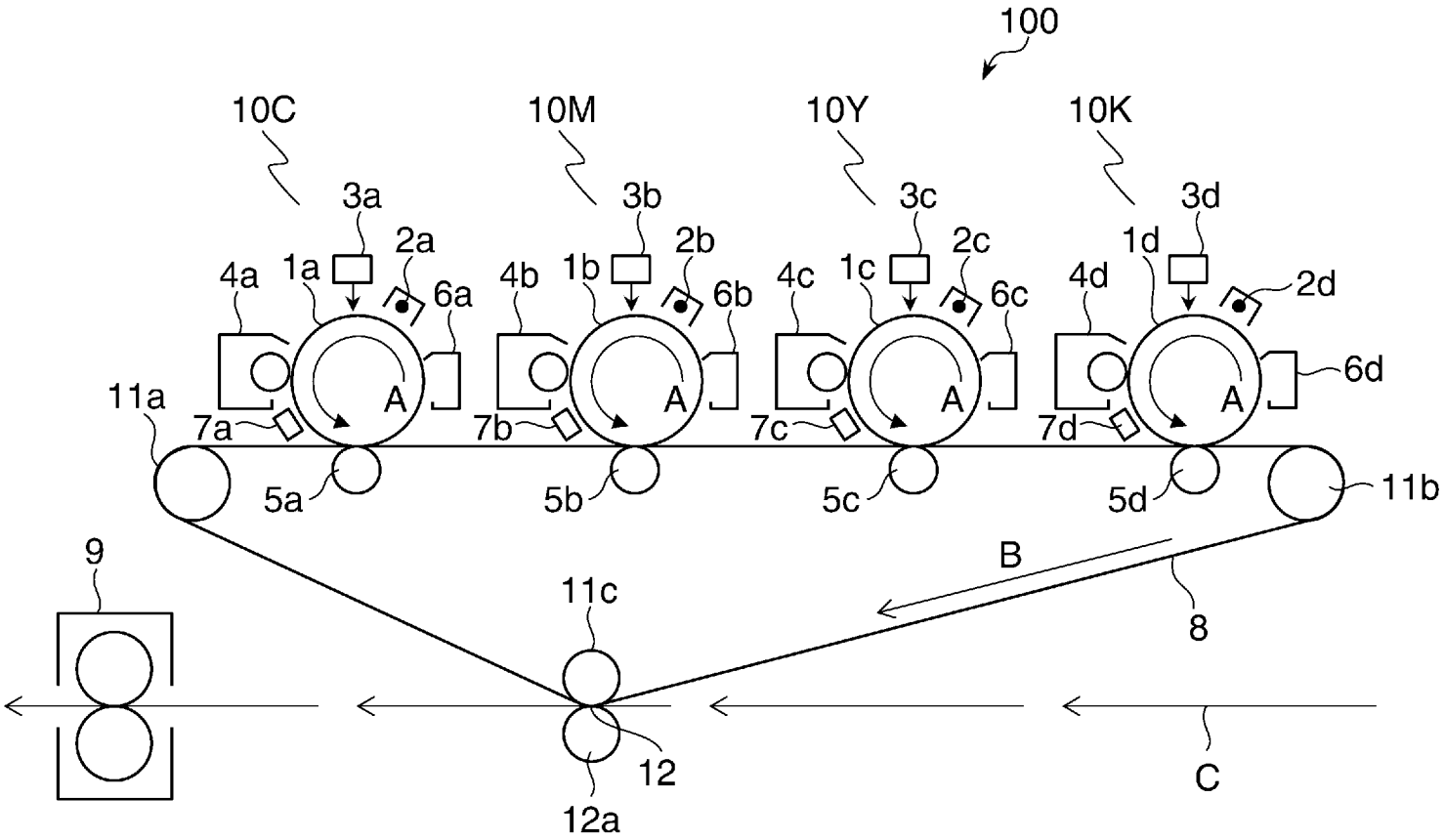
FIG. 1 is a diagram showing a schematic configuration of an image forming apparatus according to an embodiment of the present invention.

FIG. 1 is a diagram showing a schematic configuration of an image forming apparatus according to an embodiment of the present invention. In FIG. 1, the image forming apparatus 100 includes an image forming unit 10C for forming an image of cyan, an image forming unit 10M for forming an image of magenta, an image forming unit 10Y for forming an image of yellow, and an image forming unit 10K for forming an image of black.

The image forming units 10C, 10M, 10Y and 10K respectively include photosensitive drums 1*a*, 1*b*, 1*c* and 1*d* each having a photoconductive photoreceptor. Around the photosensitive drums 1*a* to 1*d*, charging apparatuses 2*a*, 2*b*, 2*c* and 2*d*, exposure apparatuses 3*a*, 3*b*, 3*c* and 3*d*, developing apparatuses 4*a*, 4*b*, 4*c* and 4*d*, and transfer rollers 5*a*, 5*b*, 5*c* and 5*d* are respectively disposed. Further, drum cleaning apparatuses 6*a*, 6*b*, 6*c* and 6*d* and potential meters 7*a*, 7*b*, 7*c* and 7*d* are provided so as to respectively correspond to the photosensitive drums 1*a* to 1*d*. The potential meters 7*a* to 7*d* measure surface potential of the photosensitive drums 1*a* to 1*d* as surface potential of the respective photoreceptor.

The photosensitive drums 1*a* to 1*d* are rotationally driven in a direction of an arrow A by a driving apparatus (not shown) driven. The charging apparatuses 2*a* to 2*d*, which are connected to a charging bias power supply (not shown), respectively, uniformly charge surfaces of the photosensitive drums 1*a* to 1*d* at predetermined potential. The exposure apparatuses 3*a* to 3*d*, which are laser beam scanners, irradiate the photosensitive drums 1*a* to 1*d* with laser lights, and expose the photosensitive drums 1*a* to 1*d*, to thereby form electrostatic latent images on the photosensitive drums 1*a* to 1*d*.

Figure 2:
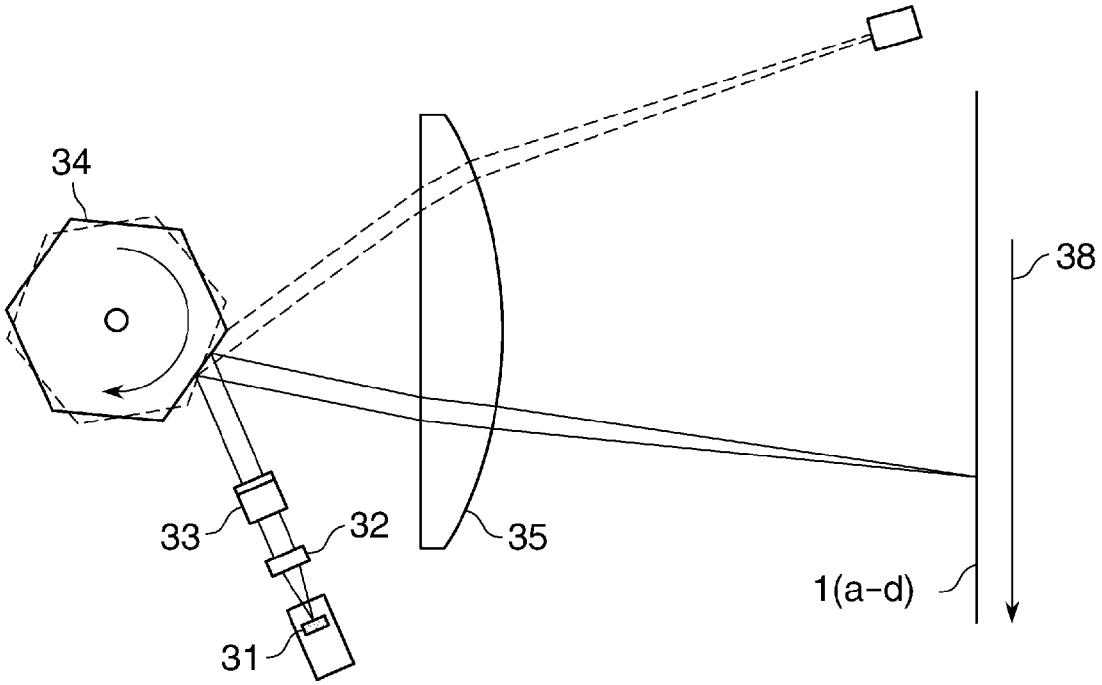
FIG. 2 is a diagram showing a configuration of an exposure apparatus in the image forming apparatus of FIG. 1.

FIG. 2 is a diagram showing a configuration of each of the exposure apparatuses 3*a* to 3*d*. In FIG. 2, each of the exposure apparatuses 3*a* to 3*d* includes a semiconductor laser 31 as a light source, a collimator lens 32, a cylindrical lens 33, a polygon mirror (rotating polygon mirror) 34 and an Fθ lens 35.

The collimator lens 32 converts laser lights emitted from the semiconductor laser 31 into parallel lights. The cylindrical lens 33 collects laser lights which pass through the collimator lens 32 in a sub scanning direction (sub scanning direction of the photosensitive drum). The polygon mirror 34 deflects the collected laser lights, and the Fθ lens 35 makes the laser lights deflected by the polygon mirror 34 form spot-like images on the photosensitive drums 1*a* to 1*d*.

The semiconductor laser 31 blinks at a predetermined intensity and at a predetermined timing according to a light emission signal of a laser driver (not shown). The laser lights emitted from the semiconductor laser 31 pass through the collimator lens 32 and the cylindrical lens 33, and are incident on the polygon mirror 34 which rotates at constant speed. The laser lights incident on the polygon mirror 34 are reflected and deflected on the mirror surface, pass through the Fθ lens 35, form spot-like images on the photosensitive drums 1*a* to 1*d*, and are scanned at constant speed in a predetermined direction 38. By this means, electrostatic latent images are formed on the photosensitive drums 1*a* to 1*d* according to the laser irradiation patterns.

Returning to FIG. 1, a yellow toner, a magenta toner, a cyan toner and a black toner are respectively stored in the developing apparatuses 4*a* to 4*d*. The developing apparatuses 4*a* to 4*d* supply the toners to the electrostatic latent images formed on the photosensitive drums 1*a* to 1*d* to develop the electrostatic latent image.

An endless intermediate transfer belt 8 as an intermediate transfer body is disposed so as to be transported between the photosensitive drums 1*a* to 1*d* and the transfer rollers 5*a* to 5*d*. The intermediate transfer belt 8 is stretched by a plurality of stretching rollers 11*a* to 11*c*. The intermediate transfer belt 8 moves and rotates in a direction of an arrow B so as to abut on surfaces of the respective photosensitive drums 1*a* to 1*d*.

A secondary transfer roller 12*a* is provided so as to face the stretching roller 11*c*, and a nip portion at which the intermediate transfer belt 8 abuts on the secondary transfer roller 12*a* serves as a secondary transfer unit 12. A paper feed roller (not shown), which feeds paper (not shown) as a recording member in a direction of an arrow C, is provided at the secondary transfer unit 12, and a fixing apparatus 9 is disposed at a downstream side in a paper conveyance direction of the secondary transfer unit 12.

In the image forming units 10C to 10K configured as described above, when an image forming signal is transmitted from a CPU (not shown), the photosensitive drums 1*a* to 1*d* rotate, and surfaces of the photosensitive drums 1*a* to 1*d* are uniformly charged to charge potential (Vd) by the charging apparatuses 2*a* to 2*d*. The uniformly charged surfaces of the photosensitive drums 1*a* to 1*d* are exposed with laser lights according to desired image data by the exposure apparatuses 3*a* to 3*d*, so that electrostatic latent images are formed.

Subsequently, the developing apparatuses 4*a* to 4*d* develop the electrostatic latent images formed on the photosensitive drums 1*a* to 1*d* using a developer to form a toner image for each color component. As the developer, for example, a two component developer comprised of a non-magnetic toner charged to negative polarity and a magnetic carrier is used, and the electrostatic latent images are developed using a bias in which an AC bias is superimposed on a DC bias.

Subsequently, the transfer rollers 5*a* to 5*d* sequentially transfer the toner images formed on the photosensitive drums 1*a* to 1*d* onto the intermediate transfer belt 8 with the toner images superimposed, to thereby form a color image. The color image formed on the intermediate transfer belt 8 is transferred onto the paper (not shown) at the secondary transfer unit 12, and fixed on the paper by the fixing apparatus 9 as a final. In this manner, printing for a printed matter is performed.

Figure 3:
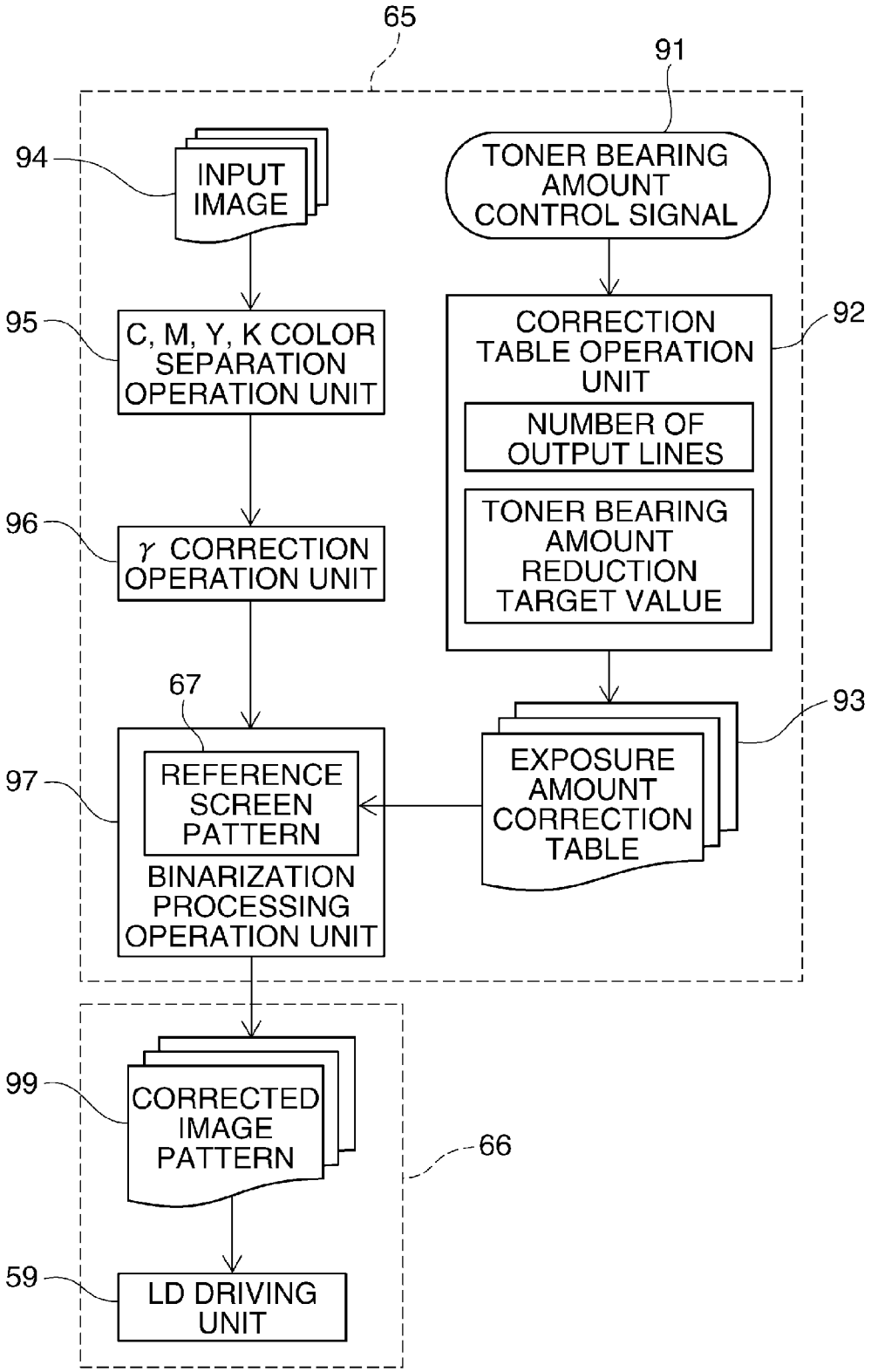
FIG. 3 is a block diagram of a control configuration for executing toner bearing amount reduction processing in the image forming apparatus of FIG. 1.

FIG. 3 is a block diagram of a control configuration for executing toner bearing amount reduction processing in the image forming apparatus of FIG. 1. In FIG. 3, the image forming apparatus 100 includes an image processing controller unit 65 and an image formation engine unit 66. The image processing controller unit 65 has a C, M, Y, K color separation operation unit 95, a γ correction operation unit 96, a binarization processing operation unit 97 and a correction table operation unit 92.

The C, M, Y, K color separation operation unit 95 separates image data corresponding to an input image into image data corresponding to respective colors of C, M, Y and K. The γ correction operation unit 96 performs γ correction on the image data corresponding to the respective colors. Here, the γ correction is a processing for correcting an image signal value of image data such that a density of an image formed by the image forming apparatus 100 become a target density. The binarization processing operation unit 97 performs binarization processing (area tone processing) after correcting, as necessary, a matrix pattern (reference screen pattern 67) which is image data subjected to γ correction. The correction table operation unit 92 generates an exposure amount correction screen pattern 68 for thinning out desired dots from a screen pattern which is a reference, that is, the reference screen pattern 67 (reference pattern) based on a toner bearing amount control signal 91 for controlling correction of a toner bearing amount.

The image formation engine unit 66 includes a laser diode (LD) driving unit 59. The LD driving unit 59 drives an LD which is a light source of the exposure apparatuses 3*a* to 3*d*, based on a corrected image pattern 99.

Toner bearing amount reduction processing using the image forming apparatus 100 of FIG. 1 will be described below. It should be noted that, OPC drums having a film thickness of 15 μm are used as the photosensitive drums, and electrostatic latent images are formed while charging the photosensitive drums to −500 V and performing exposure on the exposed portions at −150 V. Further, at this time, an optical spot having a spot diameter in a main scanning direction of 50 μm and a spot diameter in a sub scanning direction of 60 μm is used, and exposure resolution of the engine is set to 2400 dpi.

Further, as a developer, a cyan toner for C7000VP copier manufactured by Canon Inc. is used. As the fixing apparatus, a first fixing apparatus disposed at an upstream side in a paper passing direction of the C7000VP copier manufactured by Canon Inc. is used, and paper is passed through at 300 mm/s while a roller temperature is adjusted at 120° C. Further, as a recording medium, OK top coat paper manufactured by Oji Paper Co., Ltd. is used, and chroma is measured and evaluated using X-Rite530 manufactured by X-Rite Inc. It should be noted that while chroma noticeably decreases in a secondary color, chroma is evaluated using a primary color for convenience sake at this time.

Figure 4:
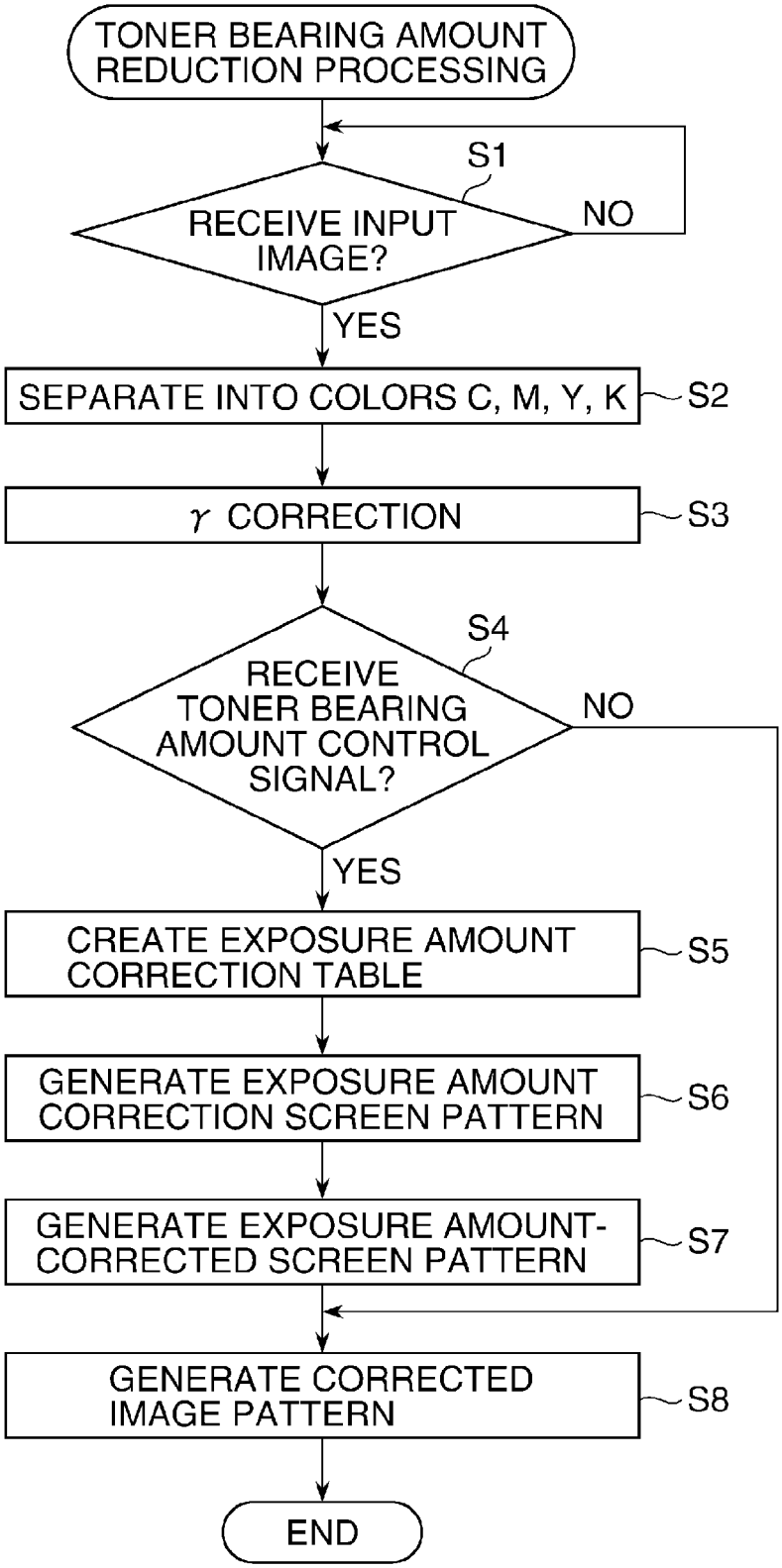
FIG. 4 is a flowchart showing procedure of the toner bearing amount reduction processing.

FIG. 4 is a flowchart showing procedure of toner bearing amount reduction processing. The toner bearing amount reduction processing is executed by the image processing controller unit 65 of the image forming apparatus 100 based on a program stored in a memory (not shown).

In FIG. 4, the image processing controller unit (hereinafter, referred to as a "controller") 65 stands by until receiving image data of the input image 94 from an external apparatus such as a PC, a scanner and a reader, etc., connected to the image forming apparatus 100 in such a manner that communication is possible (step S1). The input image 94 is, for example, a gray-scale image having gray-scale information. Subsequently, the controller 65 controls the C, M, Y, K color separation operation unit 95 to separate the image data of the input image 94 into image data corresponding to the respective colors (step S2).

Then, the controller 65 controls the γ correction operation unit 96 to execute γ correction on image data for each color component to generate the reference screen pattern 67 (FIG. 6A) to be subjected to binarization processing (step S3). The reference screen pattern 67 is tone information for tone reproduction. The C, M, Y, K color separation operation unit 95 and the γ correction operation unit 96 function as a pattern generating unit which is configured to generate the reference screen pattern 67.

Subsequently, the controller 65 determines whether or not the correction table operation unit 92 receives a toner bearing amount control signal 91 (step S4). For example, a toner bearing amount reduction target value is set by an execution of an energy saving mode is instructed by a user through an operation panel, and the correction table operation unit 92 receives the set toner bearing amount reduction target value as the toner bearing amount control signal 91. As a result of determination in step S4, when the toner bearing amount control signal 91 is received (YES to step S4), the controller 65 controls the correction table operation unit 92 to create an exposure amount correction table 93 (step S5). The exposure amount correction table 93 is created based on the number of output lines of the reference screen pattern 67 and the toner bearing amount reduction target value.

Here, a method for creating the exposure amount correction table 93 for reducing the toner bearing amount will be described.

As described above, as a method for reducing the toner bearing amount, a method in which an electrostatic latent image corresponding to a high density portion is formed using light having different exposure amounts (see U.S. Pat. No. 8,326,165), is known. That is to say, the high density portion of an image includes a region where the toner is deposited and a region where the toner is not deposited. In this method, for example, when there are two or more toner layers, irregularity of a cross section of the toner image disappears by fixing processing, resulting in a printed image with the high density portions being filled, and there is no particular problem in appearance. However, for example, when there are less than two toner layers, the toner image does not expand enough to cover foundation even after fixing processing, which cause problems that the foundation is exposed from the high density portion of the printed image, and color shade changes, etc. More specifically, in the case of a monochromatic image, a problem is caused; that a portion which the toner image cannot cover is remain on a recording medium such as paper remains, and, also in the case of a mixed color image, a problem is caused; that color mixture between colors is insufficient, which degrades coloring property.

Therefore, in the present embodiment, an exposure amount correction screen pattern for correcting an exposure amount of the reference screen pattern is generated, and the exposure amount of the reference screen pattern is corrected using the exposure amount correction screen pattern. In the present embodiment, the toner bearing amount is aimed to be reduced, for example, from 0.40 mg/cm$^2$ to 0.32 mg/cm$^2$. That is to say, the toner bearing amount reduction target value is set to 0.8.

Figure 5:
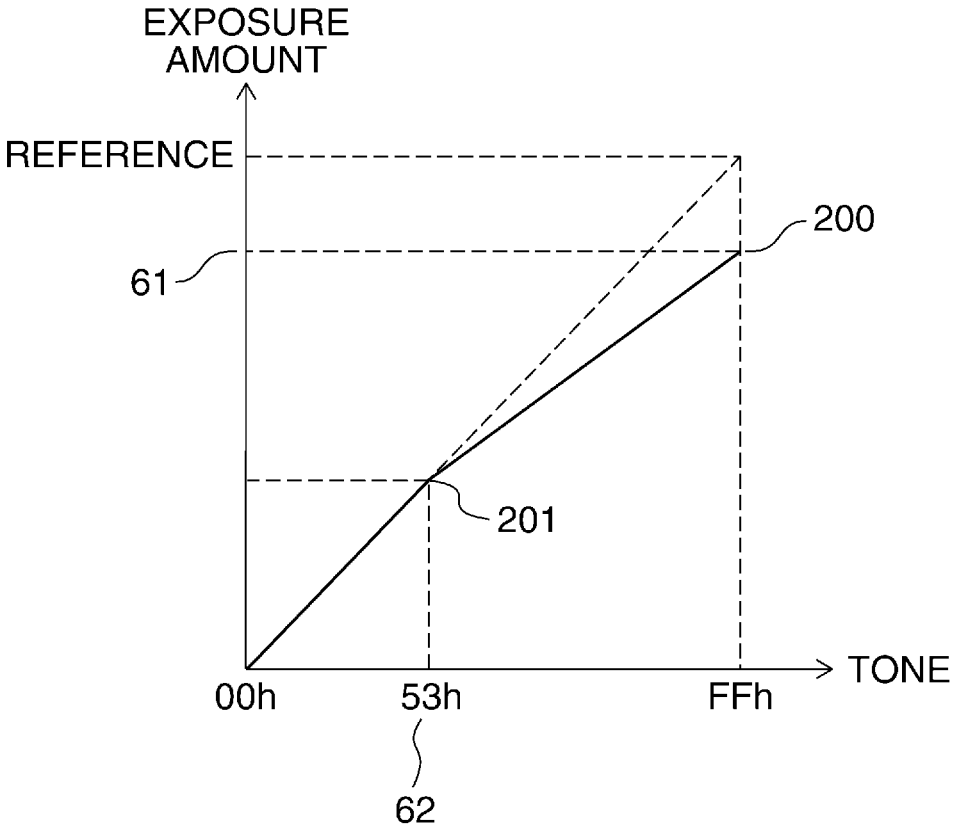
FIG. 5 is a diagram showing one example of an exposure amount correction table.

FIG. 5 is a diagram showing one example of the exposure amount correction table 93 created in step S5. The horizontal axis indicates tone of input data, expressed in hexadecimal notation. The vertical axis indicates an exposure amount which depends on exposure intensity and/or an exposure time period. The exposure amount correction table 93 is generated by the correction table operation unit 92 which receives the toner bearing amount control signal 91.

In FIG. 5, an exposure amount correction value (corrected exposure amount) 61 of a solid portion at which density is a maximum is obtained based on the toner bearing amount reduction target value received as the toner bearing amount control signal 91.

Next, correction start tone 62 is obtained based on the following equation (1).

$$\text{(Correction start tone)}=\text{(total number of tones)}/2\times\text{(number of output lines)}/300 \quad (1)$$

The equation (1) is an equation for obtaining the correction start tone according to the number of output lines when it is assumed that correction is performed from 80 h (hexadecimal notation, (the total number of tones)/2) which is an intermediate tone when the number of output lines is 300.

For example, when the number of output lines is 200, the correction start tone is 80 h×200/300, which is rounded off to 53 h. The equation (1) means that a range of a tone level at which the exposure amount should be reduced is narrowed in accordance with increase of the number of output lines, and the range of the tone level at which the exposure amount should be reduced expands in accordance with decrease of the number of output lines. It should be noted that, here, 300 is employed as a value of the denominator in the second term in the equation (1) so that, when the number of output lines is 300, the range of the tone level at which the exposure amount should be corrected to be reduced (that is, a range from the correction start tone to a maximum tone) is equal to or greater than half of the total number of tones to be output (that is the maximum tone); however, this value is not limited to 300. The value of the denominator may be determined through an experiment in advance so as to suppress collapse of the tone level.

A solid line in FIG. 5, which linearly interpolates between a point 200 corresponding to the corrected exposure amount 61 of the solid portion at which density becomes a maximum and a point 201 corresponding to the correction start tone 62, indicates the corrected exposure amount in each tone. It should be noted that, in the description of the equation (1), 80 h is a value expressed using hexadecimal notation, and is expressed as 128 in decimal notation. Further, the equation (1) means that, when the number of output lines is less than 300, the range of the tone level at which the exposure amount should be reduced is wider than a value of half of the total number of tones, while, when the number of output lines is equal to or greater than 300, the range of the tone level at which the exposure amount should be reduced is narrower than the value of half of the total number of tones.

Returning to FIG. 4, after the exposure amount correction table 93 is created, the controller 65 performs control to generate the exposure amount correction screen pattern 68 for correcting the reference screen pattern 67 (step S6). That is, based on the reference screen pattern 67, using the exposure amount correction table of FIG. 5, the controller 65 controls to generate the exposure amount correction screen pattern (exposure amount correction pattern) which specifies a thinning out amount and a thinning out position at each tone for obtaining the corrected screen pattern corresponding to the exposure amount correction table.

The correction table operation unit 92 also functions as a correction pattern generating unit. In the present embodiment, the toner bearing amount reduction target value is set to 0.8, which means that the toner bearing amount of the solid portion is aimed to be reduced by 20%. Therefore, it is necessary to also reduce the exposure amount of the solid portion by 20%. As obtained using the equation (1), the exposure amount correction screen pattern (correction pattern) 68 is generated so that an area ratio of the solid portion of the corrected screen pattern becomes −20% of an area ratio of the reference screen pattern, while setting the correction start tone 62 of the reference screen pattern as a starting point (see FIG. 6A and FIG. 6B described below).

Subsequently, the controller 65 controls to synthesize the reference screen pattern 67 and the exposure amount correction screen pattern 68 to generate an exposure amount-corrected screen pattern 70 (step S7).

Figure 6A:
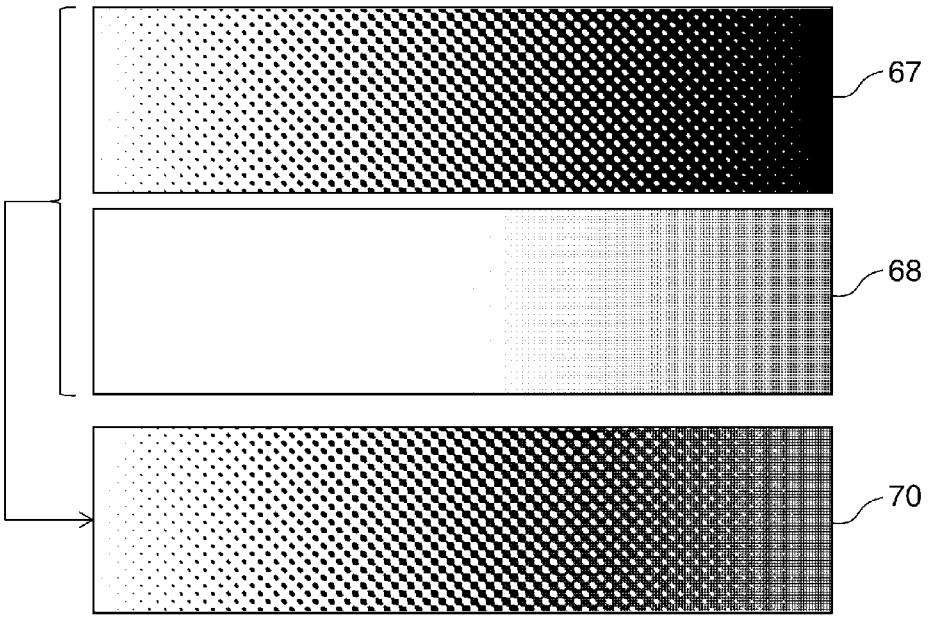
FIG. 6A and FIG. 6B are diagrams for explaining exposure amount correction.
Figure 6B:
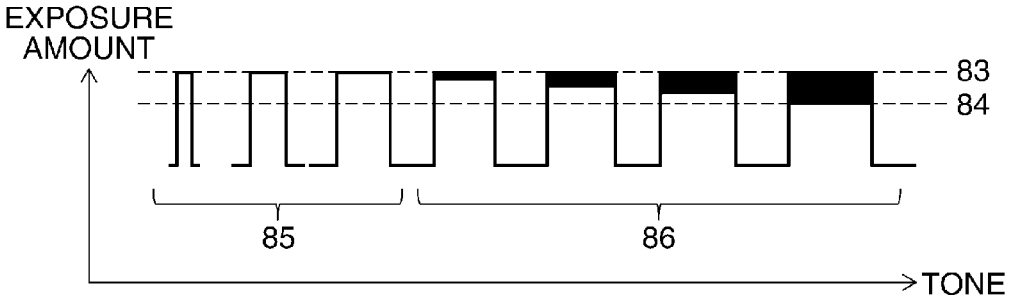

FIG. 6A and FIG. 6B are diagrams for explaining exposure amount correction. In FIG. 6A, an exposure amount-corrected screen pattern 70 is generated by synthesizing the reference screen pattern 67 and the exposure amount correction screen pattern 68. Black dotted portions of the reference screen pattern 67 indicate printed portions, and black dotted portions of the exposure amount correction screen pattern 68 indicate thinned out portions where dots are to be deleted. The exposure amount correction screen pattern 68 is tone correction information for reducing the toner bearing amount. By synthesizing the reference screen pattern 67 and the exposure amount correction screen pattern 68, dots are deleted at a region from halftone density to high density (high density portion) of the reference screen pattern 67, that is, the exposure amount-corrected screen pattern 70 in which the exposure amount has been reduced can be obtained.

FIG. 6B shows a thinned out exposure amount pattern and an exposure amount pattern in which the exposure amounts after thinning out are averaged. A region 85 corresponds to a region from low density to halftone density of the reference screen pattern 67, and a region 86 corresponds to a region from halftone density to high density of the reference screen pattern 67. It can be understood that through thinning out processing, at the region 86, that is, from the halftone density to high density, an average exposure amount per unit volume decreases. For example, at the solid portion, the exposure amount decreases from the exposure amount before thinning out 83 to the exposure amount after thinning out 84.

Figure 7:
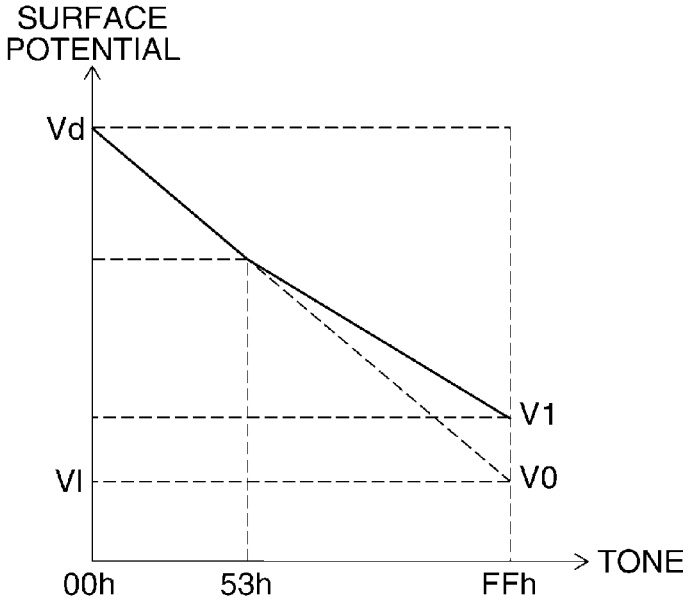
FIG. 7 is a diagram showing surface potential characteristics on a photosensitive drum corresponding to FIG. 6.

Transition of surface potential of the photosensitive drum in the exposure of the photosensitive drum performed using the exposure amount-corrected screen pattern 70 is shown in FIG. 7. In FIG. 7, a difference between potential Vd of the charged portion and potential of the exposed portion (V1=V1) of the photoreceptor, which is caused by the exposure of the photosensitive drum performed according to the exposure amount-corrected screen pattern 70, decreases compared to a difference between the potential Vd of the charged portion and potential of the exposed portion (V1=V0) of the photoreceptor, which is caused by the exposure of the photosensitive drum performed according to the reference screen pattern 67 before the exposure amount is corrected. In this way, it can be understood that a potential difference between the potential of the charged portion and the potential of the exposed portion of the photoreceptor decreases, that is, the exposure amount is reduced.

Returning to FIG. 4, the controller 65 controls the binarization processing operation unit 97 to perform binarization processing on the exposure amount-corrected screen pattern 70 to generate an corrected image pattern 99 (step S8). The binarization processing operation unit 97 also functions as a synthesizing unit, and executes processing of synthesizing the reference screen pattern 67 and the exposure amount correction screen pattern 68 to generate the exposure amount-corrected screen pattern 70.

After generating the corrected image pattern 99, the controller 65 transmits the corrected image pattern 99 to the image formation engine unit 66, the process is terminated. The LD driving unit 59 of the image formation engine unit 66 forms an electrostatic latent image corresponding to the corrected image pattern 99 on a surface of the corresponding photosensitive drum, using the corrected image pattern 99. The electrostatic latent image is developed, and a toner image is formed.

According to the processing in FIG. 4, in addition to the reference screen pattern 67 used for image formation, the exposure amount correction screen pattern 68 for thinning out dots at a region from halftone density to high density is formed. Then, by synthesizing the reference screen pattern 67 and the exposure amount correction screen pattern 68, the exposure amount of the region from halftone density to high density of the reference screen pattern 67 can be reduced. By this means, it is possible to reduce the surface potential at a region on the photosensitive drum corresponding to the high density portion of the image without affecting a latent image pattern at a low density portion of the image, and reduce the toner bearing amount. That is, it is possible to reduce the toner bearing amount by reducing the exposure amount of the reference screen pattern 67 according to the exposure amount correction screen pattern 68.

In the present embodiment, when the exposure amount correction is performed, the exposure amount correction screen pattern 68 is provided in addition to the reference screen pattern 67, as described above. By this means, it becomes possible to adjust the toner bearing amount as appropriate according to an energy saving mode, a high image quality mode and other user settings. The dot-thinning out amount of the exposure amount correction screen pattern 68 gradually increases from halftone density toward high density. Further, because dots at a region from highlight to halftone are not thinned out, that is, the exposure amount at the region from highlight to halftone of the exposure amount correction screen pattern 68 is not reduced, a tone level at the highlight side does not degrade.

Typically, if there is a gap in the latent image pattern, foundation can be seen from the gap of toners; therefore, sufficient coloring property cannot be obtained. However, in the present embodiment, image exposure is executed while image resolution of an engine is set to high resolution of 2400 dpi, and a spot diameter is set to 50 μm in a main scanning direction and 60 μm in a sub scanning direction (50 μm×60 μm), which makes it possible to form a latent image with an exposure pattern having no gap. By executing thinning out at high resolution pitch, it is possible to secure dot reproducibility in a region from highlight to halftone while reducing the toner bearing amount and while maintaining chroma at a high density portion, as indicated in Table 1 described below.

In the present embodiment, a spatial frequency of the exposure amount correction screen pattern 68 is preferably set higher than a spatial frequency of the reference screen pattern 67. The spatial frequency is the number of lines per 1 mm of the screen pattern. By this means, it is possible to uniformly form a toner image at the solid portion and form an image with favorable coloring property. Particularly, by correcting the exposure amount with a high resolution pattern using an engine having high resolution from 1200 dpi to 2400 dpi, favorable image formation can be performed. Therefore, the image resolution is preferably equal to or higher than 1200 dpi.

Next, a second embodiment of the present invention will be described below.

In the above-described first embodiment, thinning out processing is executed on a reference screen pattern having regularity using a correction screen pattern having regularity. In this case, there is a possibility that moire may occur according to conditions.

Therefore, in the present embodiment, a non-periodic pattern is applied as the correction screen pattern, and thinning out is performed on the reference screen pattern using the non-periodic pattern. By this means, it is possible to suppress occurrence of moire.

The toner bearing amount reduction processing in FIG. 4 is executed, under the same conditions as the conditions in the first embodiment except the following conditions, using the image forming apparatus 100 of FIG. 1. Namely, in the present embodiment, the number of output lines of the reference screen pattern is set to 300, and the correction start tone is set to 80 h obtained according to the above-described equation (1), and a non-periodic pattern generated using a random function is used as the exposure amount correction screen pattern.

Figure 8:
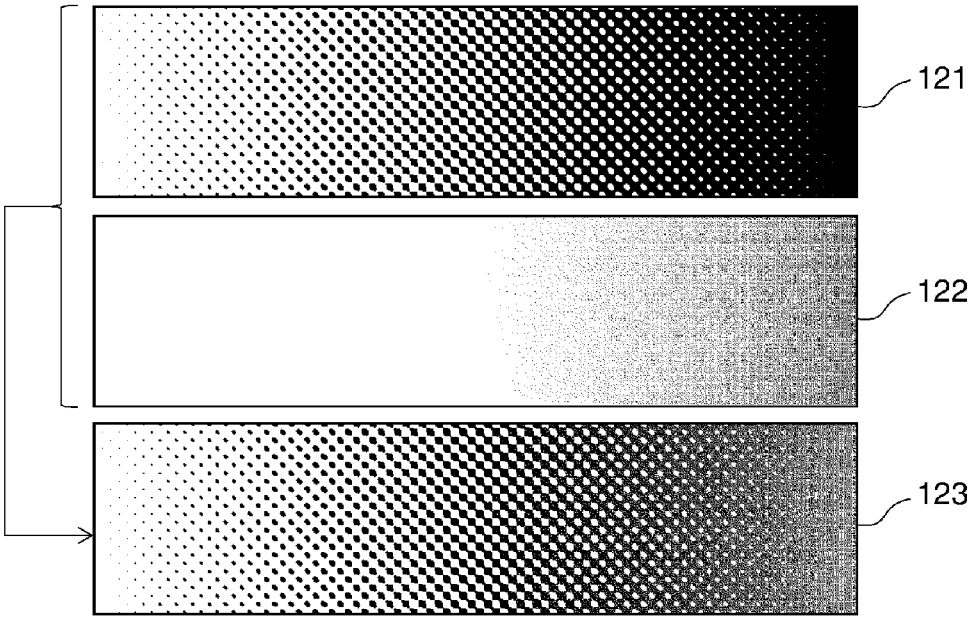
FIG. 8 is a diagram for explaining exposure amount correction in a second embodiment of the present invention.

FIG. 8 is a diagram for explaining exposure amount correction in the present embodiment. In FIG. 8, by synthesizing a reference screen pattern 121 and a non-periodic correction screen pattern 122 to correct so as to achieve an area ratio specified in the exposure amount correction table, the corrected screen pattern 123 is generated. Then, as a result of image formation being performed using the corrected screen pattern 123, an image having favorable dot reproducibility in a region from highlight to halftone and having sufficient chroma can be obtained.

According to the present embodiment, the toner bearing amount is reduced, an image having favorable dot reproducibility in a region from highlight to halftone and having sufficient chroma can be obtained, and further, occurrence of moire is not confirmed.

In the present embodiment, a screen pattern generated using a random function is used as the non-periodic screen pattern, in addition, it is also possible to use other non-periodic patterns such as a publicly-known blue noise pattern and an publicly-known error diffusion pattern.

Further, in the present embodiment, an AM screen can be used as the reference screen pattern, and an FM screen can be used as the exposure amount correction screen pattern. Also by this means, it is possible to form a favorable image on which moire does not occur.

Next, a third embodiment of the present invention will be described below.

Figure 9:
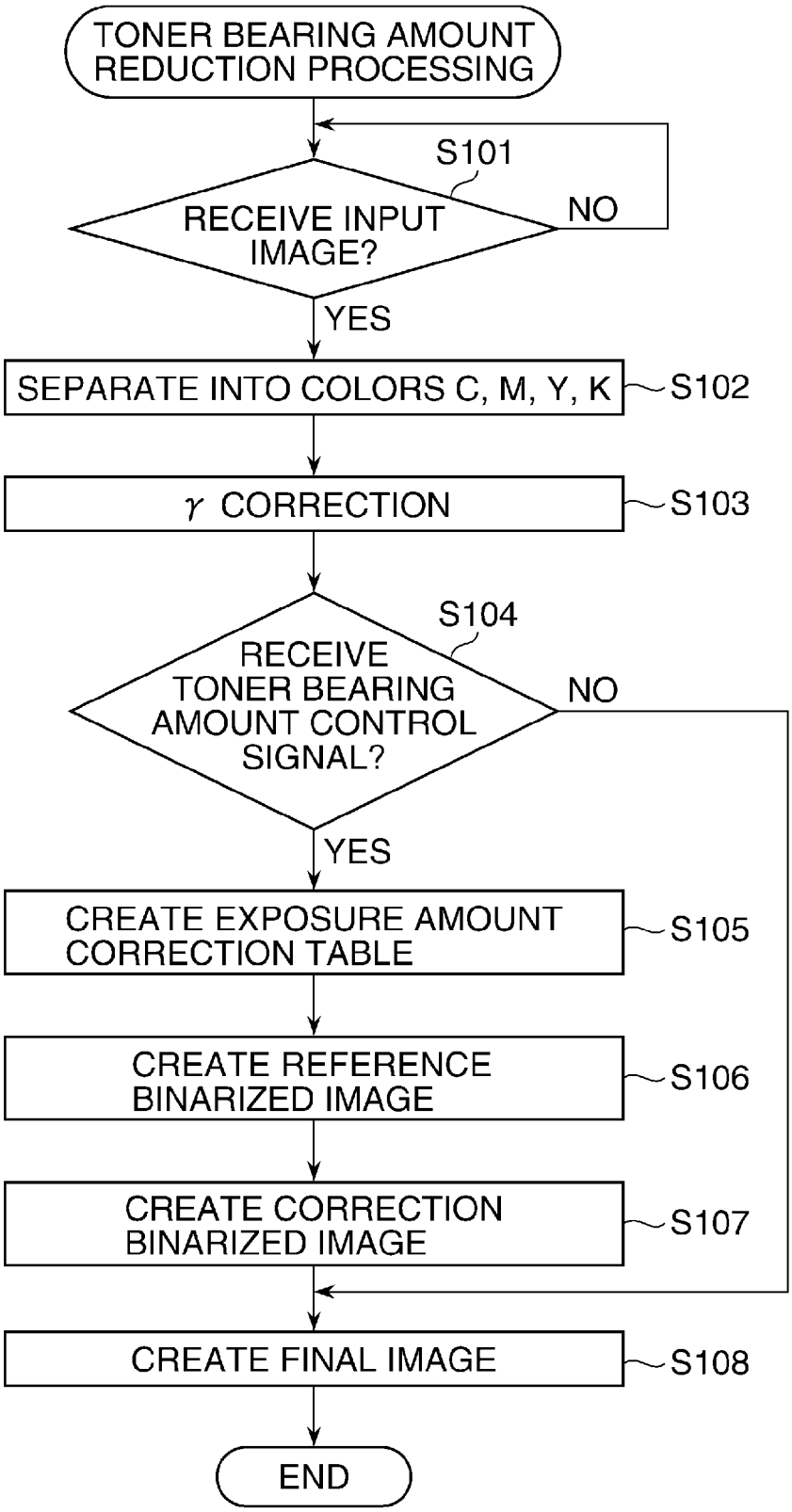
FIG. 9 is a flowchart showing procedure of toner bearing amount reduction processing in a third embodiment of the present invention.

FIG. 9 is a flowchart showing procedure of toner bearing amount reduction processing according to the third embodiment of the present invention. As in the first embodiment, the toner bearing amount reduction processing is executed by the image processing controller unit (controller) 65 of the image forming apparatus 100, based on a program stored in a memory (not shown).

In the present embodiment, the engine resolution is set to 2400 dpi, and the number of output lines of the reference screen pattern is set to 150. Therefore, correction start tone obtained using the above-described equation (1) is 40 h in hexadecimal notation (64 in decimal notation). Further, the toner bearing amount reduction target value set by the user is 0.8 (80%). According to this target value, the toner bearing amount of an image formed based on an input maximum value of 255 (decimal notation, FFh in hexadecimal notation) of an image signal decreases from 0.40 mg/cm$^2$ to 0.32 mg/cm$^2$.

In the present embodiment, because processing in steps S101 to S104 in FIG. 9 is the same as that in the first embodiment (FIG. 4), explanation thereof will be omitted, and the present embodiment will be described below, mainly concerning points different from the processing in FIG. 4.

After receiving the toner bearing amount control signal 91, the controller 65 creates an exposure amount correction table (step S105). That is, the controller 65 linearly interpolates a correction amount from an image signal of 64 (decimal notation) as the correction start tone 62 to an image signal of 255 (decimal notation), so that a correction amount of a maximum input value of 255 (decimal notation) (that is, an input value at the solid portion) becomes 20%, with reference to the above-described exposure amount correction table in FIG. 5. At this time, the correction amount corresponding to an input value of 128 (½ of the total number of tones) after linear interpolation is 6.7%, and the correction input value becomes 17, which is 6.7% of the maximum input value of 255 as shown in FIG. 10.

Figure 10:
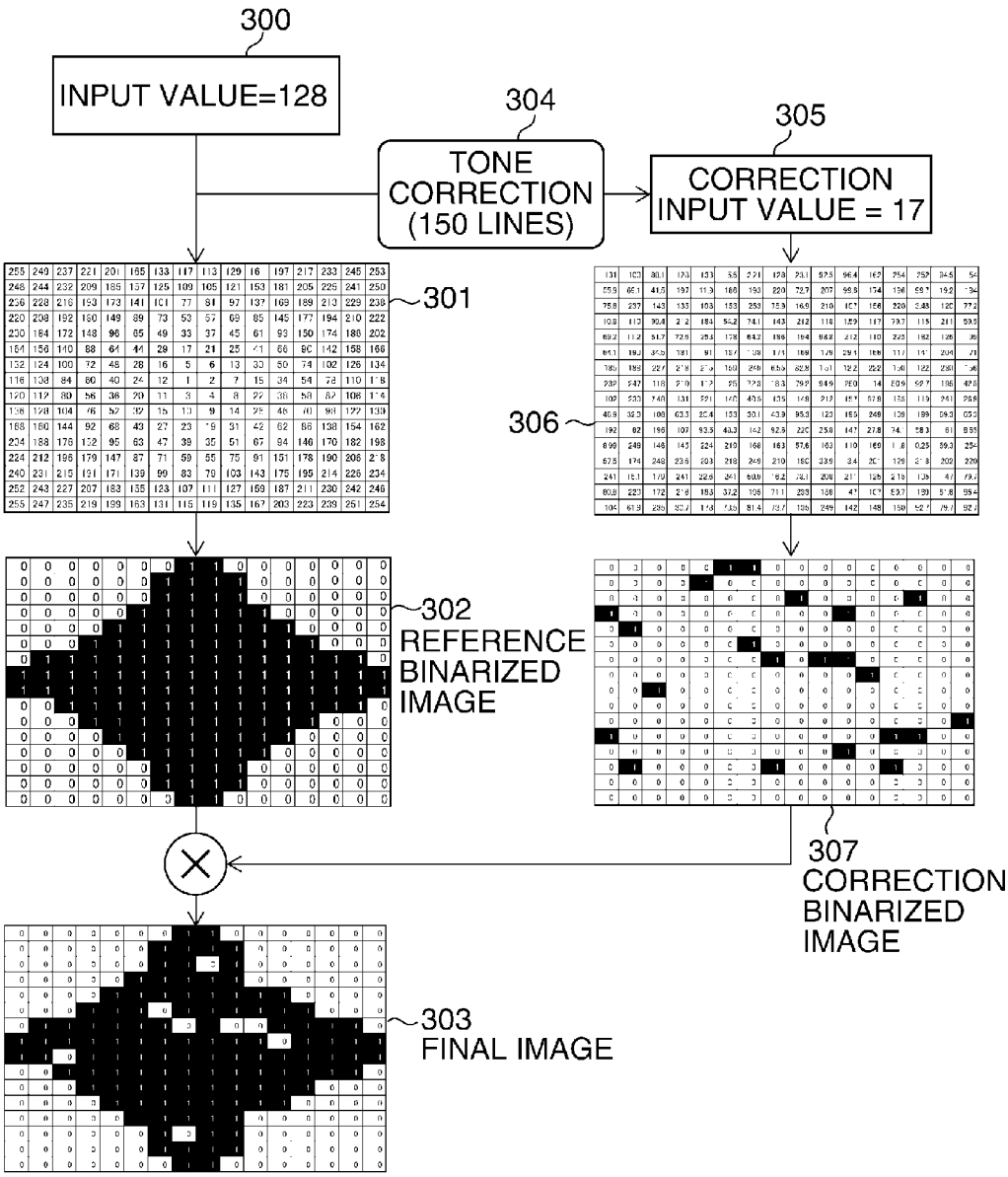
FIG. 10 is a matrix diagram for explaining an exposed amount-corrected screen pattern in the third embodiment of the present invention.

FIG. 10 is a matrix diagram for explaining the exposure amount-corrected screen pattern in the third embodiment of the present invention. In FIG. 10, a final image 303 is generated based on a reference binarized image 302 obtained by binarizing a reference screen pattern 301 and a correction binarized image 307 obtained by binarizing a correction screen pattern 306.

Returning to FIG. 9, the controller 65 then creates the reference binarized image 302 by performing comparison operation on the input value 300 using the reference screen pattern 301 (step S106) (FIG. 10). The controller 65 then performs tone correction based on the exposure amount correction table created in step S105. That is, the controller 65 creates the correction binarized image 307 by performing comparison operation on the correction input value 305 using the correction screen pattern 306 (step S107). The controller 65 then creates the final image 303 by performing comparison operation on the reference binarized image 302 with the correction binarized image 307 (step S108), the process is terminated. Then, as a result of image formation being performed using the final image 303, an image having favorable dot reproducibility in a region from highlight to halftone and having sufficient chroma can be obtained.

According to the processing in FIG. 9, the reference binarized image 302 and the correction binarized image 307 are created, and the final image 303 is created by performing comparison operation on the reference binarized image 302 with the correction binarized image 307. By this means, as with the above-described embodiments, it is possible to reduce the toner bearing amount of the solid portion without affecting a latent image pattern in a region from highlight to halftone. It should be noted that, in the present embodiment, the same value is used for all pixels in the shown matrix; however, the processing, which is the same with the processing of the present embodiment, is also possible to be performed even if values of the respective pixels are different from one another.

Next, Comparison Example 1 will be described below.

In the above-described first embodiment, the exposure amount correction screen pattern 68 is generated such that the exposure amount of the high density portion of the screen pattern is reduced, and the exposure amount correction screen pattern 68 is synthesized with the reference screen pattern 67 to reduce the exposure amount.

On the other hand, in Comparison Example 1, simply, exposure is performed, while reducing exposure intensity of the exposure apparatus which is an exposure unit.

Figure 11:
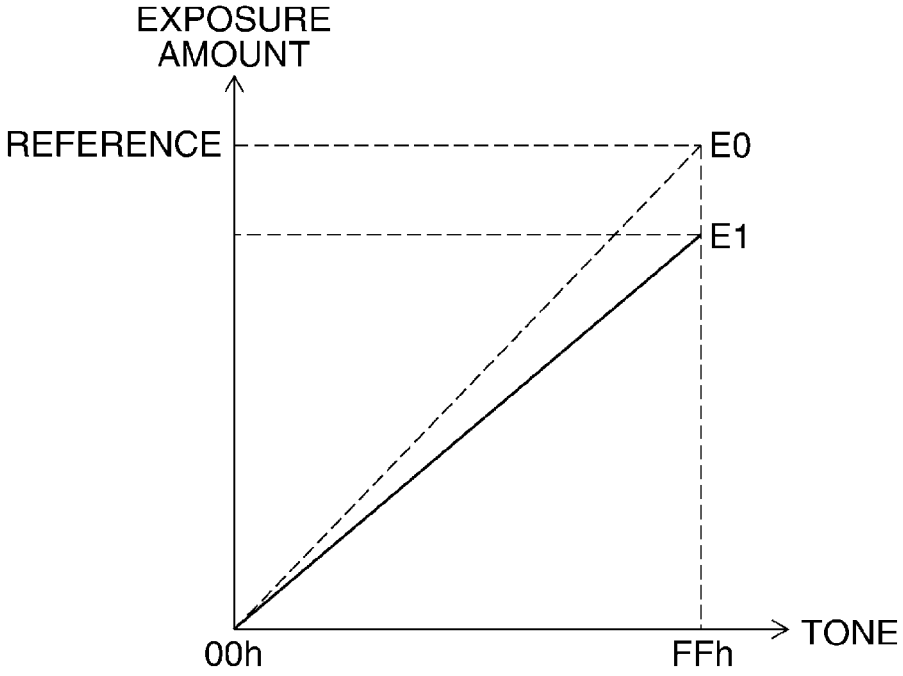
FIG. 11 is a diagram for explaining an exposure amount correction table in Comparison Example 1.

FIG. 11 is a diagram for explaining an exposure amount correction table in Comparison Example 1. In FIG. 11, the horizontal axis indicates tone of input data, while the vertical axis indicates the exposure amount. When exposure intensity of the exposure apparatus is reduced, the exposure amount is uniformly reduced over all tones (E1), as compared to the exposure amount before the reduction (E0). Surface potential of the photosensitive drum at this time is shown in FIG. 12.

Figure 12:
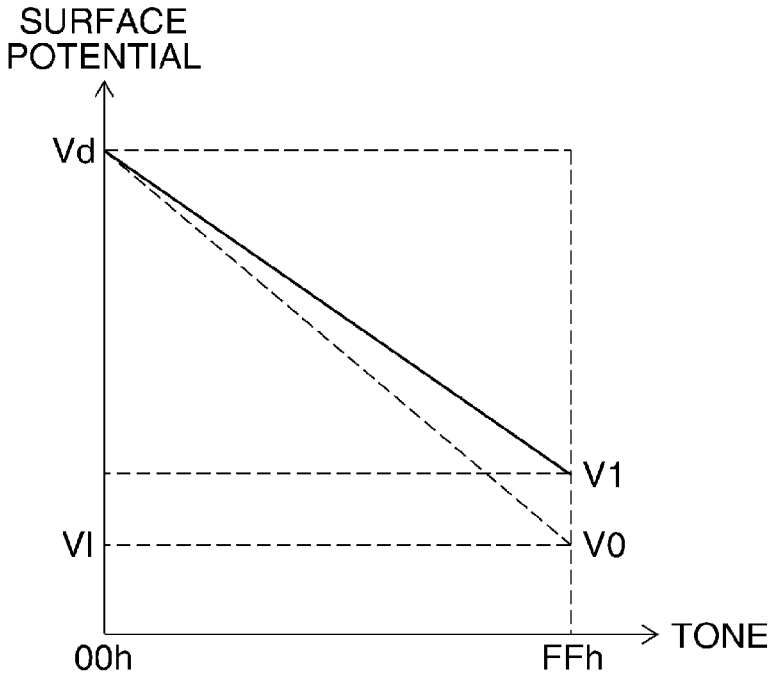
FIG. 12 is a diagram showing surface potential characteristics of a photosensitive drum corresponding to FIG. 11.

FIG. 12 is a diagram showing surface potential characteristics of the photosensitive drum corresponding to FIG. 11. In FIG. 12, the surface potential of the photosensitive drum changes from V0 to V1 over all the tones in accordance with decrease in exposure intensity of the exposure apparatus.

Potential distribution of the latent image pattern in a case when area tone processing is performed under such conditions will be described using FIG. 13A and FIG. 13B, and FIG. 14A and FIG. 14B.

Figure 13A:
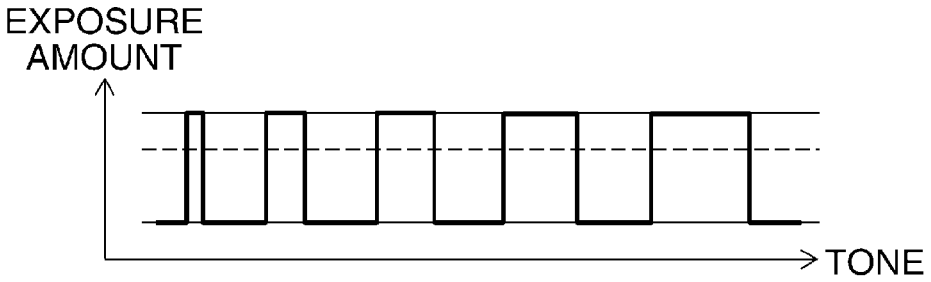
FIG. 13A and FIG. 13B are diagrams for explaining latent image distribution in a region from highlight to halftone before an exposure amount is reduced.
Figure 13B:
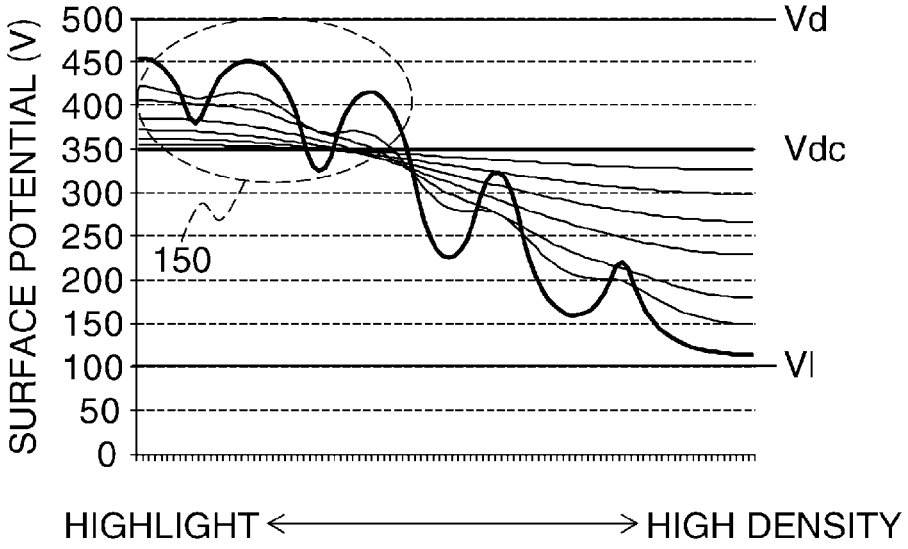
Figure 14A:
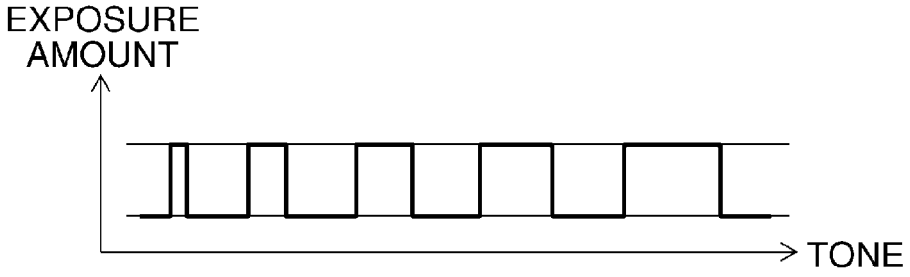
FIG. 14A and FIG. 14B are diagrams for explaining latent image distribution in a region from highlight to halftone after the exposure amount is reduced.
Figure 14B:
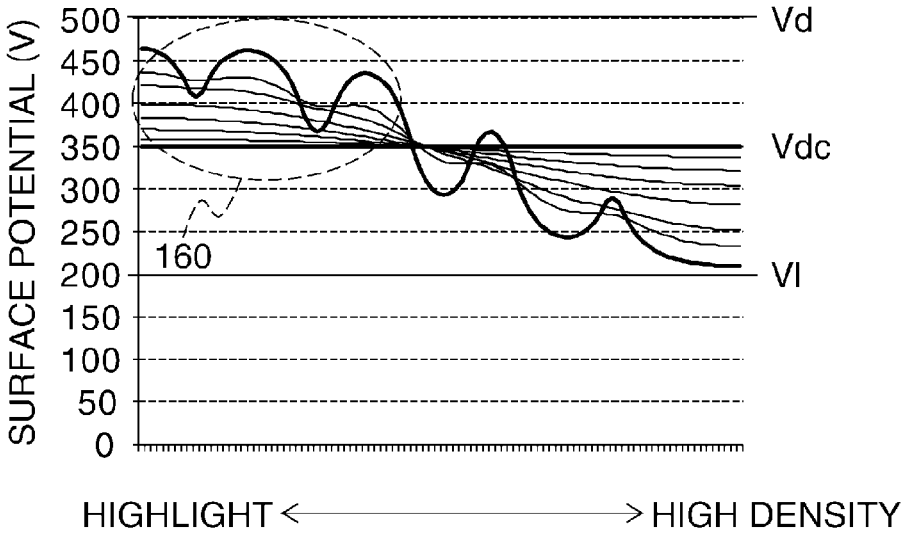

FIG. 13A and FIG. 13B are diagrams for explaining latent image distribution in a state before the exposure amount is reduced (E0 in FIG. 11). Further, FIG. 14A and FIG. 14B are diagrams for explaining latent image distribution in a state after the exposure amount is reduced (E1 in FIG. 11).

In FIG. 13A and FIG. 13B, and FIG. 14A and FIG. 14B, potential at a region of highlight is reduced, as shown by the reduction from the potential of a portion 150 before the reduction of the exposure amount to the potential of a portion 160 after the reduction of the exposure amount, and falls below a DC component (Vdc) of a development bias. A difference between the potential of highlight and the surface potential of the photosensitive drum charged by the charging apparatus Vd is extremely small. That is, when the difference between the surface potential of a region, at which the image is formed on the photosensitive drum, and the surface potential of the photosensitive drum charged by the charging apparatus decreases, the reproducibility of the image precipitously degrades.

Figure 15A:
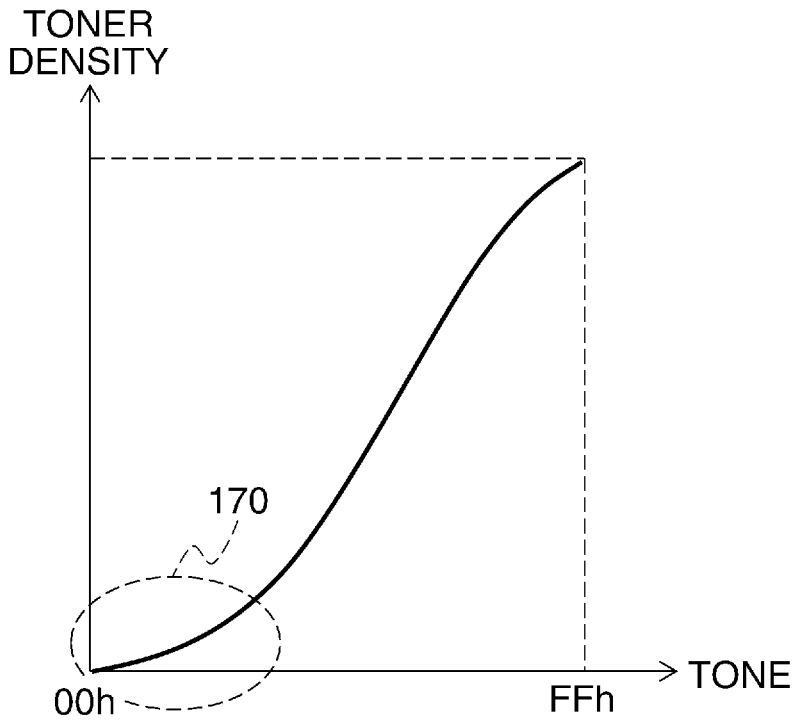
FIG. 15A and FIG. 15B are diagrams for explaining tone reproduction in a region from highlight to halftone before the exposure amount is reduced.
Figure 15B:
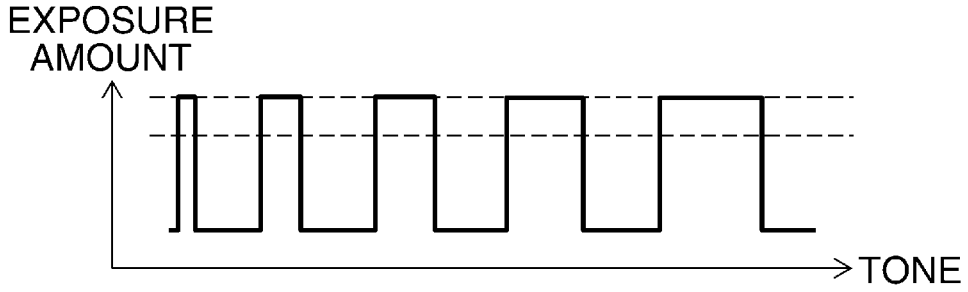
Figure 16A:
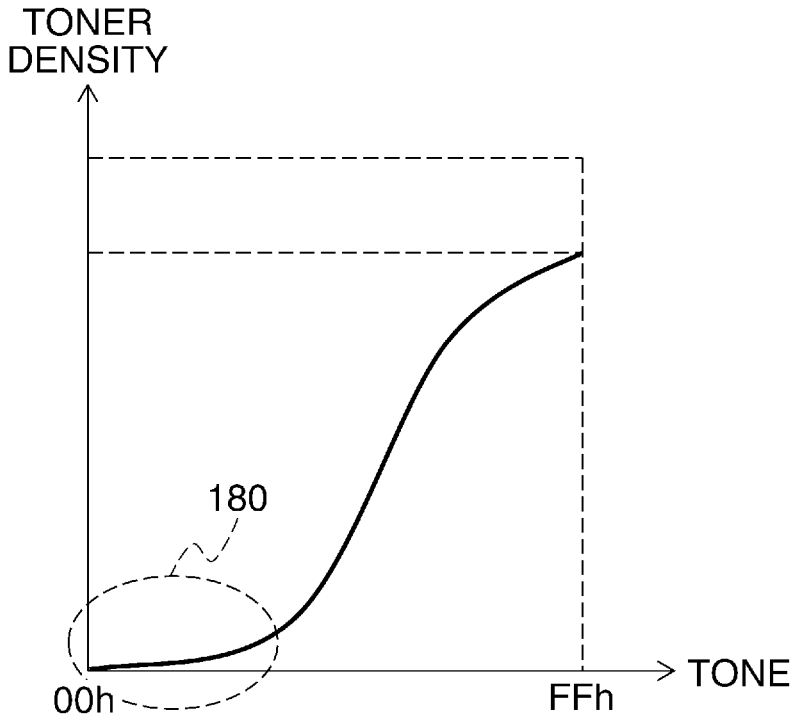
FIG. 16A and FIG. 16B are diagrams for explaining tone reproduction in a region from highlight to halftone after the exposure amount is reduced.
Figure 16B:
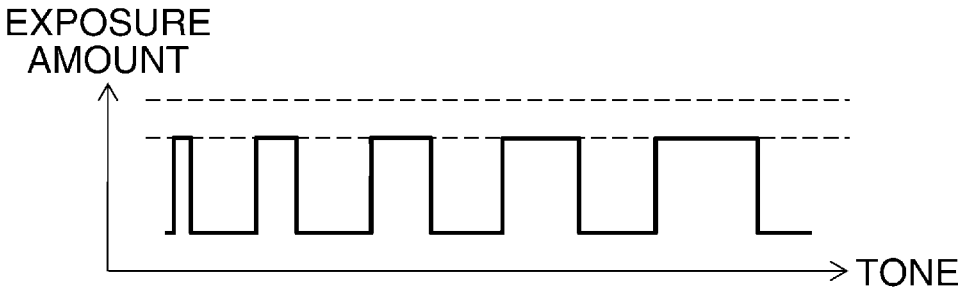

FIG. 15A and FIG. 15B are diagrams for explaining tone reproduction in a region from highlight to halftone before the exposure amount is reduced. FIG. 16A and FIG. 16B are diagrams for explaining tone reproduction in a region from highlight to halftone after the exposure amount is reduced.

In FIG. 15A and FIG. 16A, the horizontal axis indicates tone of input data, while the vertical axis indicates toner density. As is clear from a portion 170 in FIG. 15A before the exposure amount is reduced and a portion 180 in FIG. 16A after the exposure amount is reduced, by reducing the exposure amount, dot reproducibility in a region from highlight to halftone precipitously degrades. That is, in Comparison Example 1, it can be understood that while the toner bearing amount of the solid portion decreases in accordance with decrease of the exposure amount, and chroma is favorable, on the other hand, dot reproducibility in a region from highlight to halftone drastically degrades.

Comparison Example 2 will be described below.

Figures 17A, 17B:
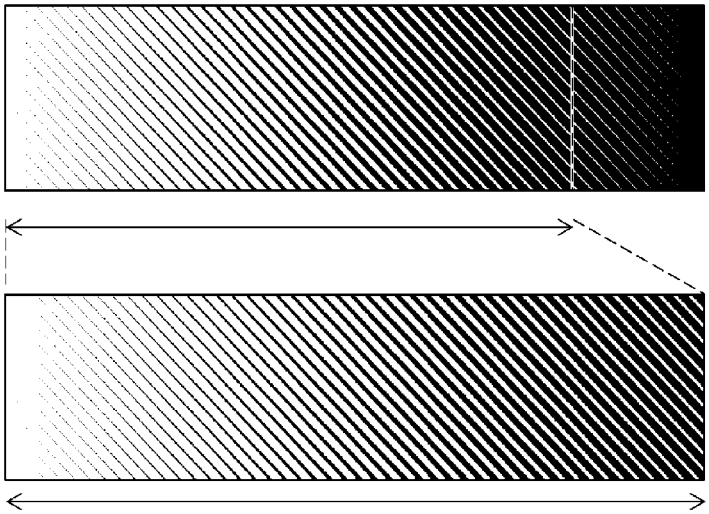
FIG. 17A and FIG. 17B are diagrams for explaining line screen processing.

As processing for reducing the exposure amount at a high density portion of a screen pattern, line screen processing which is described in the prior art (U.S. Pat. No. 8,326,165) is executed, and an image is formed based on a screen pattern obtained by the line screen processing (see FIG. 17B). As a result, because an exposure area decreases in a unit of pixel while exposure intensity is not changed, an average exposure amount of the high density portion decreases, and the toner bearing amount also decreases in accordance with the decrease of the average exposure amount. Further, because the exposure intensity is not changed, dot reproducibility in a region from highlight to halftone is favorable.

However, as indicated in the following Table 1, an irregular structure at the time of exposure remains in a toner structure of the high density portion, which reduces chroma, accordingly, a satisfactory image cannot be obtained. In Table 1, "o" means that "result is favorable", and "x" means that "result is not favorable".

TABLE 1

| | EMBODIMENT 1 | EMBODIMENT 2 | EMBODIMENT 3 | COMPARISON EXAMPLE 1 | COMPARISON EXAMPLE 2 |
|---|---|---|---|---|---|
| DOT REPRODUCIBILITY IN REGION FROM HIGHLIGHT TO HALFTONE | ○ | ○ | ○ | × | ○ |
| CHROMA | ○ (60) | ○ (60) | ○ (60) | ○ (60) | × (54) |

It can be understood from Table 1 that, according to the first embodiment, the second embodiment and the third embodiment in which the exposure amount correction screen pattern 68 is synthesized with the reference screen pattern 67, it is possible to obtain an image having favorable dot reproducibility in a region from highlight to halftone and having favorable chroma. In contrast to this, according to Comparison Example 1 in which the exposure amount of the exposure unit is simply reduced and Comparison Example 2 in which line screen processing is executed according to the prior art (U.S. Pat. No. 8,326,165), it is impossible to obtain a satisfactory result in dot reproducibility in a region from highlight to halftone or chroma.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-171637, filed Aug. 26, 2014, which is hereby incorporated by reference wherein in its entirety.

What is claimed is:

1. An image forming apparatus comprising:

a first generating unit configured to generate a reference pattern;

a second generating unit configured to generate, based on image data, a correction pattern for thinning out dots at a region from halftone density to high density;

a converting unit configured to convert the image data based on the reference pattern generated by the first generating unit and the correction pattern generated by the second generating unit;

a photoreceptor;

a charging unit configured to charge the photoreceptor;

an exposure unit configured to expose the charged photoreceptor based on the image data converted by the converting unit, to form an electrostatic latent image; and a developing unit configured to develop the electrostatic latent image.

2. The image forming apparatus according to claim 1, wherein a dot-thinning out amount of the correction pattern gradually increases from a halftone region toward a high density region.

3. The image forming apparatus according to claim 1, wherein at a region from highlight to halftone of the correction pattern, the dots are not thinned out.

4. The image forming apparatus according to claim 1, wherein a spatial frequency of the correction pattern is higher than a spatial frequency of the reference pattern.

5. The image forming apparatus according to claim 1, wherein a non-periodic screen pattern is used as the correction pattern.

6. The image forming apparatus according to claim 5, wherein the non-periodic screen pattern is any one of a pattern generated using a random function, a blue noise pattern, and an error diffusion pattern.

7. A control method for controlling an image forming apparatus having a photoreceptor, the control method comprising:

a first generating step of generating a reference pattern;

a second generating step of generating, based on image data, a correction pattern for thinning out dots at a region from halftone density to high density;

a converting step of converting the image data based on the reference pattern generated at the first generating step and the correction pattern generated at the second generating step;

a charging step of charging the photoreceptor;

an exposing step of exposing the photoreceptor charged at the charging step based on the image data converted at the converting step, to form an electrostatic latent image; and a developing step of developing the electrostatic latent image to form an image.

8. A storage medium storing a program causing a computer to execute a control method for controlling an image forming apparatus having a photoreceptor, the control method comprising:

a first generating step of generating a reference pattern;

a second generating step of generating, based on image data, a correction pattern for thinning out dots at a region from halftone density to high density;

a converting step of converting the image data based on the reference pattern generated at the first generating step and the correction pattern generated at the second generating step;

a charging step of charging the photoreceptor;

an exposing step of exposing the photoreceptor charged at the charging step based on the image data converted at the converting step, to form an electrostatic latent image; and a developing step of developing the electrostatic latent image to form an image.

9. An image processing apparatus comprising:

a first generating unit configured to generate first image data by performing AM screen processing on image data;

a second generating unit configured to generate second image data by performing FM screen processing on the image data; and a creating unit configured to create third image data for forming an image by performing thinning out processing on the first image data based on the second image data.

10. The image processing apparatus according to claim 9, wherein the second image data is data indicative of whether to perform the thinning out processing, and wherein, in a case where the second image data indicates that the thinning out processing is to be performed, the first image data is thinned out.

11. The image processing apparatus according to claim 9, wherein the first image data is binary data based on a result of comparison between an input value of the image data and a first threshold value, and wherein the second image data is binary data based on a result of comparison between the input value of the image data and a second threshold value.

12. The image processing apparatus according to claim 11, wherein, in a case where the first image data is data indicative of dots on which an image is formed and the second image data is data indicative of dots on which an image is not formed, the third image data is data indicative of dots on which an image is not formed.

13. The image processing apparatus according to claim 12, wherein, in a case where a signal value of the image data is smaller than a predetermined value and the first image data shows a first signal value, the third image data shows a signal value indicative of dots on which an image is formed.

14. The image processing apparatus according to claim 13, wherein the predetermined value is determined based on the number of input lines in the AM screen processing performed by the first generating unit.

15. The image processing apparatus according to claim 12, wherein, in a case where a signal value of the image data is greater than a predetermined value, the first image data shows a first signal value, the second image data shows a second signal value, and the third image data shows a signal value indicative of dots on which an image is not formed.

16. The image processing apparatus according to claim 15, wherein the predetermined value is determined based on the number of input lines in the FM screen processing performed by the second generating unit.

17. The image processing apparatus according to claim 9, wherein the FM screen processing includes image processing using a blue noise pattern.

* * * * *